United States Patent [19]

Grogan et al.

[11] Patent Number: 4,615,467

[45] Date of Patent: Oct. 7, 1986

[54] LIQUID FOAM DISPENSER

[75] Inventors: Richard P. Grogan, Downey; Douglas F. Corsette, Los Angeles, both of Calif.

[73] Assignee: Calmar, Inc., Watchung, N.J.

[21] Appl. No.: 758,428

[22] Filed: Jul. 24, 1985

[51] Int. Cl.[4] ..... B67D 5/58

[52] U.S. Cl. ..... 222/189; 222/190; 222/211; 239/327; 239/343

[58] Field of Search ..... 239/327-328, 239/338, 343-344, 303-304, 366-371; 222/189, 190, 206-207, 211-212, 215, 464, 564

[56] References Cited

U.S. PATENT DOCUMENTS

| | | | |
|---|---|---|---|
| 3,709,437 | 1/1973 | Wright | 239/343 |
| 3,794,247 | 2/1974 | Corsette | 239/327 |
| 3,937,364 | 2/1976 | Wright | 222/190 |
| 4,018,364 | 4/1977 | Wright | 222/190 |
| 4,022,351 | 5/1977 | Wright | 222/145 |
| 4,147,306 | 4/1979 | Bennett | 239/327 |
| 4,156,505 | 5/1979 | Bennett | 239/327 |
| 4,184,615 | 1/1980 | Wright | 222/190 |
| 4,274,594 | 6/1981 | Ito | 239/327 |
| 4,432,496 | 2/1984 | Ito | 239/327 |
| 4,509,661 | 4/1985 | Sugizaki et al. | 222/190 |
| 4,531,659 | 7/1985 | Wright | 222/190 |

*Primary Examiner*—Joseph J. Rolla
*Assistant Examiner*—Michael S. Huppert
*Attorney, Agent, or Firm*—Watson, Cole, Grindle & Watson

[57] ABSTRACT

A liquid foam dispenser having a porous foamer element includes a liquid passage and a distributor for distributing the liquid across the outer surface of the foamer element during actuation, an air passage for transmitting pressurized air during actuation through the foamer element pores for generating a foam on or from the outer surface of the foamer element, and a separate vent passage permitting a rapid recovery of the container during depressurization.

11 Claims, 4 Drawing Figures

LIQUID FOAM DISPENSER

BACKGROUND OF THE INVENTION

This invention relates generally to a squeeze bottle dispenser for discharging a liquid foam, and more particularly to such a dispenser wherein, upon actuation, the flow of foamable liquid is distributed across the outer surface of a foam homogenizing element or filter which is penetrated by air transmitted through the filter for generating foam, and a venting means which prevents air ingestion through the liquid product.

Various foam dispensers combined with a deformable container of foamable liquid have been devised for producing foam during each squeeze stroke as the applied manual pressure is transmitted to the foamable product to be dispensed from the container as well as to the air therewithin, the product and air being mixed prior to discharge and both being emitted through a foam homogenizing element or filter which serves to homogenize and control the density of foam discharged through the discharge port. In each of these known foamers, however, the product issues through the homogenizing element giving rise to a tendency to clog especially when dispensing film forming products or those containing suspended solids. Thus, irrespective of the porosity and/or thickness of the homogenizing element, clogging by such liquid products is difficult to avoid.

In addition, prior foamers of the aforedescribed type provide for admission of atmospheric air into the container typically through the liquid product passage so as to permit reexpansion of the squeeze bottle upon release after each squeeze or discharge stroke. Thus, the entering air replaces the column of product in such passage whereupon a portion of each squeeze stroke or compression of the squeeze bottle is necessary in merely restoring the product column to its former level before any subsequent discharge of product can occur.

SUMMARY OF THE INVENTION

It is therefore an object of the present invention to provide a liquid foam dispenser for squeeze bottles having a foam homogenizing or foamer element wherein the liquid product, during the squeeze stroke, does not pass through the pores of the element but is distributed as a layer across the outer surface thereof where it is interfaced with air being evenly transmitted through the foamer element in fine jets for constantly purging the foamer element and for generating foam on or from the outer surface thereof to thereby preclude clogging of the pores.

Another object of this invention is to provide such a foamer having a valve controlled vent passage which separate from the liquid and air passages, the foamer element having a through opening and the liquid passage communicating only with the outer surface of the element lying adjacent the discharge port, the air passage leading to the inner surface of the foamer element, and a liquid distributor for radially distributing the foamable liquid onto the outer surface of the element upon pressurization of the container so as to interface with the air penetrating the element upon such pressurization, which air penetrates the flow from the distributor and generates foam on or from the outer surface of the element.

A further object of the present invention is to provide such a foamer wherein the liquid passage includes a one-way valve preventing air from entering the interior of the container through the liquid passage upon depressurization of the container.

A still further object of the invention is to provide such a foamer wherein a discharge head is mounted for axial movement for opening and closing the discharge port.

A still further object is to provide such a foamer wherein the distributor has a surface parallel to the outer surface of the homogenizing element for distributing a layer of foamable liquid onto such outer surface. The distributer surface may have radial grooves formed therein to assure an even distribution of such layer.

Other objects, advantages and novel features of the invention will become more apparent from the following detailed description of the invention when taken in conjunction with the accompanying drawings.

DETAILED DESCRIPTION OF THE INVENTION

Figure 1:
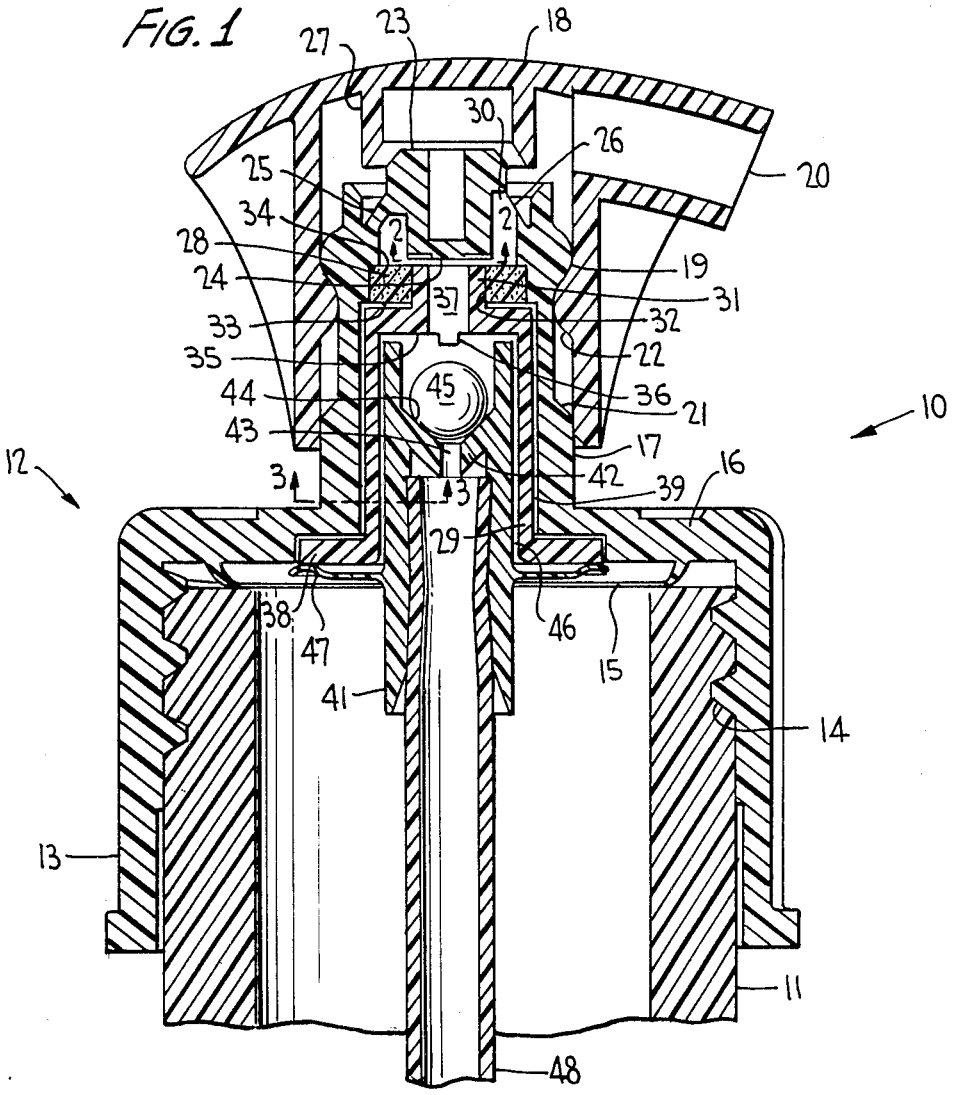
FIG. 1 is a vertical sectional view of one embodiment of the liquid foamer according to the invention.
Figure 4:
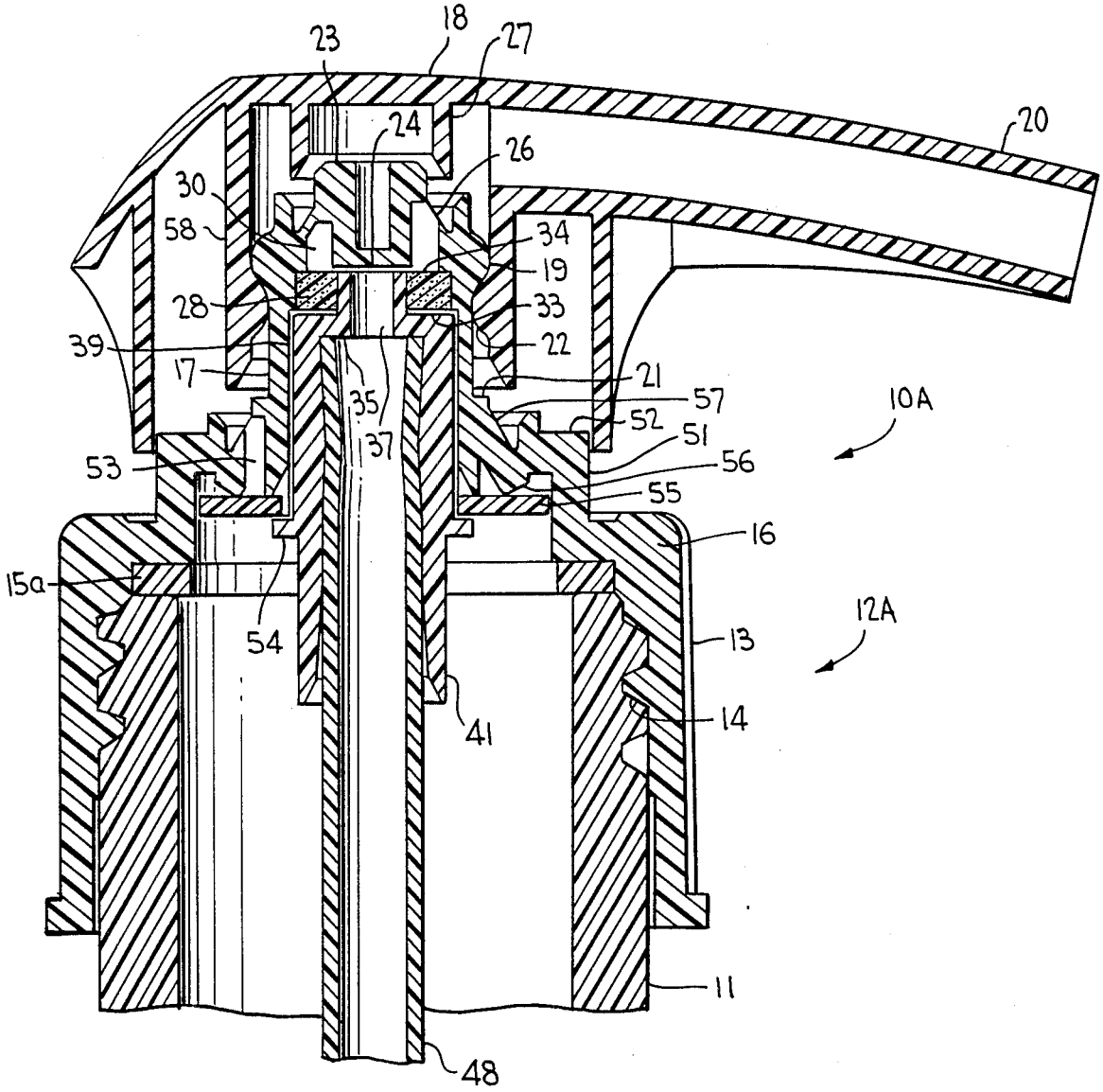
FIG. 4 is a vertical sectional view of another embodiment of a liquid foamer according to the invention.

Turning now to the drawings wherein like reference characters refer to like and corresponding parts through the several views, a liquid foam dispenser generally designated 10 in FIG. 1 is adapted for fitment onto a neck 11 of a deformable container (not otherwise shown) having a resiliently flexible wall or wall portion which may be alternately squeezed or indented to expel a portion of its contents and then released. Such a container is commonly termed a "squeeze bottle." The bottle contains a quantity of liquid product to be dispensed, which may include a foaming agent, and air normally occupies the upper portion of a squeeze bottle above its liquid contents. The dispenser comprises a closure cap 12 having a skirt 13 which may be internally threaded as at 14 for cooperation with the external threads on the bottle neck. Otherwise, skirt 13 may comprise a ferrule for snap fitting engagement with the container neck. An integral, annular, curved gasket 15 may be provided at the underside of an upper wall 16 of the closure cap overlying the upper edge of the bottle neck for providing a liquid tight seal therewith. Otherwise, a flat annular gasket 15*a* of elastomeric material may be secured to the under surface of wall 16 for the same purpose, as shown in FIG. 4.

The closure cap includes a cylindrical wall portion 17 supporting a discharge head 18 for axial movement between a discharge open position shown in FIG. 1, and an inwardly shifted position (not shown) for closing the discharge. Head 18 has a conventional discharge spout 20, and wall portion 17 has a reduced outer diameter defining axially spaced limit stops 19 and 21 engaged by an inwardly directed bead 22 on the discharge head when shifted between its discharge open and closed positions. Depending skirt 27 and the wall of groove 25 may also abut to act as stop means in the inward direction in concert with or instead of engagement between bead 22 and shoulder 21.

Wall portion 17 is capped at its outer end as at 23, the undersurface of the cap presenting a distributer element 24 for radially distributing liquid product upon pressurization of the squeeze bottle in a manner to be described in more detail hereinafter. A foaming chamber 30 surrounds element 28. And, an annular groove 25 surrounding cap 23 has at least one discharge port 26 formed therein, a depending collar 27 on the discharge head being seated within groove 25 for closing the discharge port in an inwardly shifted discharge closed position (not shown) of the head during storage and shipping conditions of non-use.

A foam homogenizing or foamer element in the form of an annular disk 28 is secured in place in any normal manner within a portion of wall 17. The disk lies parallel to and at a spaced predetermined distance from the surface of distributer element 24. A hat-shaped element forming a cap 29 is friction fitted or otherwise secured within cylindrical wall portion 17, and has an outer hollow projection 31 received within an opening 32 provided in the disk so as to extend fully between inner and outer surfaces 33 and 34 of the disk, the end edge of projection 31 lying substantially in the same plane as outer surface 34. This projection 34 is formed on a wall 35 of cap 29, and a plurality of nibs 36 are provided on wall 35 surrounding the edge of a liquid metering opening 37 defined by hollow projection 31.

Cap 29 has an annular flange 38 at its inner end, and the outer surfaces of the cap at its main body portion, its wall 35 and its flange 38 are provided with aligned grooves 39 extending from the interior of the container and leading to inner surface 33 of disk 28. Otherwise, these grooves may be provided in the confronting surfaces of the closure cap itself. In any event, these grooves together define an air passage.

The cap surrounds and frictionally supports a hollow sleeve 41 which may have an inwardly sloping conical wall portion 42 containing a coaxial opening 43 and defining at its outer surface a valve seat 44. A ball check valve 45 is gravity seated on its valve seat and is normally spaced a short distance beneath nibs 36. Of course, other equivalent types of inlet check valves can be provided, such as a flap valve or the like.

The outer and upper end surfaces of sleeve 41 are provided with a plurality of grooves 46 (See also FIG. 3) defining vent passages leading from the interior of the container to the inside of sleeve 41 at its upper end. Otherwise, the confronting surfaces of element 29 may be provided with such grooves. Alternatively, ribs could be provided on one or the other, or both confronting surfaces of elements 17, 29, 41 for defining such vent passages. And, sleeve 41 includes an annular resilient and flexible vent valve 47 which normally seats against the undersurface of flange 38 for closing the vent passage.

Figure 2:
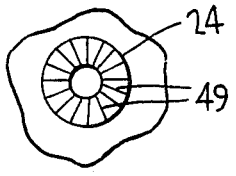
FIG. 2 is a plan detail view taken substantially along the line 2—2 of FIG. 1.

A conventional dip tube 48 is supported on sleeve 41 and extends into the liquid product within the container, the tube forming a part of a liquid passage of the dispenser. And, the surface of distributer element 24 is provided with a plurality of grooves 49 which may be radially disposed, as shown in FIG. 2, or may be spirally or tangentially disposed.

In operation, as pressure is applied to the deformable container or squeeze bottle, as by means of a manual squeeze stroke, such pressure is transmitted to the flowable product to be dispensed from the container as well as to the air therwithin. The liquid product is thereupon forced up through the dip tube, unseats ball check valve 45 from its seat, flows through material opening 37 and impacts against the surface of distributer element 24 so as to be radially (spirally or tangentially) distributed across the upper surface 34 of disk 28 where it is interfaced with air being evenly distributed through the pores of foamer element 28 in fine jets, simultaneously upon pressurization of the bottle. This air transmitted through the disk penetrates the flow from the distributer, and generates a foam on or from outer surface 34 of the disk so as to be purged from foaming chamber 30, through port 26 and spout 20, without leaving residual liquid in the foaming chamber after actuation. The porous foamer element or disk 28 is subject to a constant air purging or cleansing with the complete exclusion of any liquid product passing through the pores of the foamer element itself. Such action precludes any clogging of the foamer element pores by, for example, film forming liquids or liquids containing suspended solids. A layer of liquid product is distributed only across outer surface 34 of disk 28 without penetrating or filling the pores of the foamer element, so as to completely avoid any clogging of the pores as the air transmitted therethrough from air passage 39 generates a foam as aforedescribed and completely purges the foamer element as well as the foaming chamber after pressurization. And, any escape of the air through vent passage 46 is prevented, upon pressurization of the container, by seating of valve 47 against its valve seat in response to the pressure transmitted to the air within the bottle.

It is manifest that foamed product will be intermittently discharged through discharge port 26 and spout 20 each time the container is compressed as by manual squeezing. Between squeeze strokes, when the pressure is released and the container is permitted to reexpand, the rexpansion tendency will produce a sub-atmospheric pressure within the container interior so that the atmospheric pressure acting against vent valve 47 will flex the latter downwardly to unseat or open it and permit air to freely enter the container through vent passage 46 which is separate from the liquid product passage. And, during this recovery of the container, atmospheric pressure closes valve 44 against its valve seat preventing air from entering the interior of the container through the liquid passage. Thus, the liquid passage within the dip tube remains fully primed in readiness for discharge of a maximum volume of product on each squeeze stroke. Also, if air were vented into the container through the tube 48, the air would form bubbles which would float to the top of the liquid and fill the air space with coarse foam, detrimentally preventing proper discharge of air on subsequent strokes. This would also tend to clog the filter with product from this foam in the air chamber for many types of products.

Figure 3:
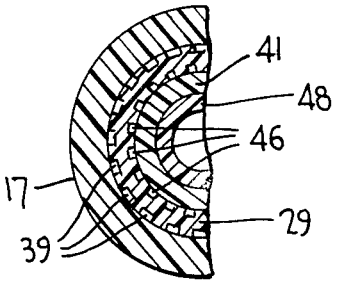
FIG. 3 is a cross-sectional view taken substantially along the line 3—3 of FIG. 1.

Foaming dispenser 10A of FIG. 4 is essentially the same in construction and operation as that described with reference to FIGS. 1 to 3, and like parts will be identified by the same reference numerals.

Closure cap 12A differs slightly in that a short collar 51 extends outwardly of wall 16 thereof, and a lateral wall 52 extends inwardly of the collar. This wall 52 has a vent opening 53 formed therin, and cylindrical wall portion 17 extends outwardly of wall 52.

Hat-shaped member 29 of FIG. 1 is eliminated in the FIG. 4 embodiment. Thus, hollow sleeve 41 is frictionally or otherwise supported at its upper end within cylindrical wall portion 17, sleeve 41 being otherwise the same as sleeve 41 of FIG. 1 in that it likewise has grooves 39 forming an air passage. However, this sleeve has an annular external flange 54 for supporting a resilient and flexible annular vent valve 55 which bears against the lower edge of wall portion 17. An annular lip 56 which may terminate in a sharp edge depends from wall 52, and the vent valve is seated thereagainst for closing vent opening 53 in the FIG. 4 position.

The outer surface of wall 52 contains an annular groove 57 into which vent 53 opens. Discharge head 18 is essentially the same as that described with reference to FIG. 1 except that its depending skirt 58 is received at its lower end within groove 57 when the head is shifted downwardly in a non-use position of shipping or storage. In such position, not shown, the discharge port 26 as well as vent opening 23 are sealed closed.

Dispenser 10A operates the same as dispenser 10 of FIG. 1. Thus, the dispenser head is shifted outwardly to its FIG. 4 position in readiness for foam dispensing which is effected upon application of external manual pressure against the deformable container whereupon liquid product is forced up the dip tube, through metered liquid opening 37 and flows across upper surface 34 of foamer element 28 as distributed by distributer element 24 described in detail with reference to FIG. 1. At the same time the air within the bottle which is pressurized during the squeeze stroke is forced through air passage 39 to inner surface 33 of the foamer element and passes through the pores thereof exiting in fine jets so as to interface with the layer of product distributed across outer surface 34. This air under pressure penetrates the flow from the distributer, and generates a foam on or from outer surface 34 of the foamer element so as to be purged from foaming chamber 30 without leaving any residual liquid in this chamber after each pressure stroke. As in the FIG. 1 embodiment, the constant air purging of the porous foamer element and the exclusion of liquid from passing through the foamer element precludes clogging of the foamer element pores by especially those liquids which form films or contains suspended solids.

During the depressurization or recovery stroke, the reexpansion tendency of the bottle will produce a below atmospheric pressure within the container interior so that the outside atmospheric pressure acting against vent valve 55 will flex the latter downwardly to unseat or open it and permit air to freely enter the container through vent passage 53 which is separate from the liquid passage along which liquid product is discharged. As can be seen, the vent is sized to present less resistance to flow of air into the container during the recovery stroke compared to that of the liquid passage or air passage. The column of product remaining in the dip tube after pressurization presents a resistance to recovery air through the liquid passage, and the porous foamer element presents resistance to recovery air through the air passage.

From the foregoing, it can be seen that air purging the porous foamer element during actuation of the dispenser according to the invention avoids problems of clogging in that the liquid product never passes through or penetrates the foamer element but is rather distributed across the outer surface thereof and interfaces with air transmitted through the foamer element. The spacing between the distributer element and the upper surface of the foamer element can be gauged if necessary to accommodate various types of liquids to be dispensed. Moreover, the foam dispenser of the invention provides for rapid recovery through a vent passage formed separately from the liquid passage.

Obviously, many other modifications and variations of the invention are made possible in the light of the above teachings. It is therefore to be understood that within the scope of the appended claims the invention may be practiced otherwise that as specifically described.

What is claimed:

1. A liquid foam dispenser comprising a closure member having a discharge port and mounted on a-deformable container of foamable liquid, a foam homogenizing element on said member adjacent said port, means supported on said closure for defining a liquid passage, an air passage and a valve-controlled vent passage, said element having an opening extending between outer and inner side surfaces thereof, said liquid passage extending from the interior of the container and communicating only with said outer surface of said element which lies adjacent said discharge port, said air passage extending from said container interior and leading to said inner surface of said element, and a liquid distributor for distributing the foamable liquid on to said outer surface of said element upon pressurization of the container so as to interface with air penetrating said element upon said pressurization to thereby effect foaming of the liquid before discharging through said port.

2. The dispenser according to claim 1, wherein said liquid passage includes a one-way valve preventing air from entering the interior of said container through said liquid passage upon depressurization of the container.

3. The dispenser according to claim 1, wherein said passage defining means has a flexible valve thereon for controlling said vent passage.

4. The dispenser according to claim 1, wherein said closure member and said passage defining means define confronting surfaces, grooves located in at least one of said surfaces for forming said air passage.

5. The dispenser according to claim 1, further comprising a discharge head mounted for axial movement on said closure member between open and closed positions, said head having a discharge passage in communication with said port in said open position and having means thereon for closing said port in said closed position.

6. The dispenser according to claim 1, wherein said distributor has a surface lying parallel to said one side surface of said homogenizing element at a predetermined distance therefrom for distributing a layer of foamable liquid on to said one surface.

7. The dispenser according to claim 6, wherein said distributor surface has a plurality of radial grooves formed therein to assure an even distribution of said layer.

8. The dispenser according to claim 2, wherein said vent passage extends from the container interior to said liquid passage outwardly of said one-way valve.

9. The dispenser according to claim 1, wherein said passage defining means comprise a hollow sleeve supporting a dip tube and a one-way valve preventing air from entering the container interior through said liquid passage upon depressurization of the container, and a surrounding cap having a hollow projection extending through said opening in said element.

10. The dispenser according to claim 9, wherein at least one of the confronting surfaces of said sleeve and said cap has grooves therein forming said vent passage.

11. The dispenser according to claim 10, wherein said sleeve has an annular, flexible valve thereon for controlling said vent passage.

* * * * *